US011390110B2

(12) United States Patent
Chen et al.

(10) Patent No.: US 11,390,110 B2
(45) Date of Patent: Jul. 19, 2022

(54) MULTI-PURPOSE COMBINATION WRITING INSTRUMENT

(71) Applicant: PENGEA INC., Brooklyn, NY (US)

(72) Inventors: Jason Chen, Brooklyn, NY (US); Richard Mark, New York, NY (US)

(73) Assignee: PENGEA INC., Brooklyn, NY (US)

( * ) Notice: Subject to any disclaimer, the term of this patent is extended or adjusted under 35 U.S.C. 154(b) by 0 days.

(21) Appl. No.: 17/291,738

(22) PCT Filed: Nov. 6, 2019

(86) PCT No.: PCT/US2019/060023

§ 371 (c)(1),
(2) Date: May 6, 2021

(87) PCT Pub. No.: WO2020/097173

PCT Pub. Date: May 14, 2020

(65) Prior Publication Data

US 2022/0009270 A1 Jan. 13, 2022

Related U.S. Application Data

(60) Provisional application No. 62/756,412, filed on Nov. 6, 2018.

(51) Int. Cl.
*B43K 23/06* (2006.01)
*B43K 24/04* (2006.01)
(Continued)

(52) U.S. Cl.
CPC ..... *B43K 23/06* (2013.01); *B43K 8/003* (2013.01); *B43K 24/04* (2013.01); *B43K 29/004* (2013.01); *B43K 29/007* (2013.01)

(58) Field of Classification Search
CPC ..... B43K 23/06; B43K 24/04; B43K 27/02; B43K 27/08; B43K 29/004; B43K 29/007;
(Continued)

(56) References Cited

U.S. PATENT DOCUMENTS 1,783,436 A 12/1930 Kratochvil
1,938,835 A * 12/1933 Grzyb ..... B43K 27/08 401/35
(Continued)

FOREIGN PATENT DOCUMENTS

CN 2055444 U 4/1990
CN 2181402 Y 11/1994
(Continued)

OTHER PUBLICATIONS

International Application No. PCT/US2019/060023, International Search Report and Written Opinion dated Jan. 16, 2020, 7 pages.
(Continued)

*Primary Examiner* — David P Angwin
*Assistant Examiner* — Bradley S Oliver
(74) *Attorney, Agent, or Firm* — Liang & Hennessey LLP; Stanley D. Liang

(57) ABSTRACT

A multi-purpose combination writing instrument comprising: at least three individual writing instruments, each individual writing instrument comprising a barrel having a proximal end and a distal end; a base having opposing first and second ends, the first end of the base comprising at least three receivers, wherein each receiver is adapted to receive the proximal end of the barrel of a corresponding individual writing instrument, and the second end of the base having at least three tape flag platforms disposed therein; and a cap rotatably mounted on the second end of the base over the at least three tape flag platforms, wherein an opening in the cap
(Continued)

provides access to one tape flag platform at a time as it rotates around the second end of the base.

25 Claims, 10 Drawing Sheets

(51) Int. Cl.
*B43K 29/00* (2006.01)
*B43K 29/007* (2006.01)
*B43K 8/00* (2006.01)

(58) Field of Classification Search
CPC . B43K 29/12; B65D 83/0805; B65D 83/0894
See application file for complete search history.

(56) References Cited

U.S. PATENT DOCUMENTS

| | | | | |
|---|---|---|---|---|
| 2,005,110 | A | 6/1935 | Ritzert | |
| 2,301,364 | A | 11/1942 | Bruck | |
| 4,603,993 | A | 8/1986 | Jung | |
| 4,646,453 | A | 3/1987 | Reinhart | |
| 4,963,048 | A * | 10/1990 | Thomas | B43K 24/04 401/99 |
| 5,605,001 | A | 2/1997 | Derk | |
| 6,386,777 | B1 | 5/2002 | Lee | |
| 6,719,472 | B2 * | 4/2004 | Windorski | B43K 29/12 401/195 |
| 6,905,275 | B1 | 6/2005 | Del Valle | |
| 6,921,223 | B2 | 7/2005 | Marschand | |
| 7,051,899 | B1 * | 5/2006 | Offenhauer | B42D 5/005 221/124 |
| 7,168,105 | B2 | 1/2007 | Adelman | |
| 7,517,167 | B2 * | 4/2009 | Smith, Jr. | B43K 29/12 401/195 |
| 7,547,155 | B2 * | 6/2009 | Windorski | B42D 5/006 401/243 |
| 8,016,506 | B2 | 9/2011 | Adamberry | |
| 9,022,677 | B1 | 5/2015 | Hughes | |
| 9,659,512 | B2 | 5/2017 | Lee | |
| 10,414,202 | B2 | 9/2019 | Chen et al. | |
| 2005/0100393 | A1 | 5/2005 | Lin | |
| 2005/0109790 | A1 * | 5/2005 | Hsu | B65D 83/0805 221/61 |
| 2006/0165470 | A1 | 7/2006 | Gerules | |
| 2008/0226378 | A1 | 9/2008 | Sheu | |
| 2017/0087922 | A1 | 3/2017 | Dorpmund | |
| 2017/0239976 | A1 * | 8/2017 | Chen | B43K 27/08 |
| 2019/0039404 | A1 * | 2/2019 | Cunningham | B43K 8/028 |

FOREIGN PATENT DOCUMENTS

| | | | |
|---|---|---|---|
| CN | 2424936 | Y | 3/2001 |
| CN | 2763054 | Y | 3/2006 |
| CN | 2902746 | Y | 5/2007 |
| CN | 200967321 | Y | 10/2007 |
| CN | 201296105 | Y | 8/2009 |
| CN | 201362080 | Y | 12/2009 |
| CN | 203126228 | U | 8/2013 |
| DE | 9101160 | U1 | 6/1991 |
| EP | 2039528 | A2 | 3/2009 |
| EP | 2436531 | A1 | 4/2012 |
| JP | T1418239 | Y | 12/1925 |
| JP | S57118886 | U | 7/1982 |
| JP | S57138674 | U | 8/1982 |
| JP | S57193583 | U | 12/1982 |
| JP | H2111589 | U | 9/1990 |
| JP | 2006321131 | A | 11/2006 |
| JP | 2010179540 | A | 8/2010 |
| WO | 2004103725 | A1 | 12/2004 |
| WO | 2007102043 | A1 | 9/2007 |

OTHER PUBLICATIONS

Japanese Application No. 2017-526046, Office Action dated Feb. 26, 2019, 7 pages.
Chinese Action received in Chinese Application No. 201580038734.1 dated Jan. 26, 2018, pp. 20.
Office Action received in U.S. Appl. No. 15/329,708 dated Feb. 26, 2019, pp. 1-13.
Office Action received in U.S. Appl. No. 16/567,810 dated Sep. 23, 2020, pp. 1-6.

* cited by examiner

MULTI-PURPOSE COMBINATION WRITING INSTRUMENT

TECHNICAL FIELD

This disclosure relates to implements for writing, highlighting, or drawing, particularly to combinations of writing implements with attached informational devices and/or detachable adhesive backed writing sheets.

BACKGROUND

Writing instruments have been combined with other writing instruments or other articles to perform more than one function with a single device, for ease of use. For example multi-color pens enable one to write in multiple colors with a single device. Erasers have been attached to pencils to enable users to write and erase with the same instrument. Pens with retractable banners imprinted with a map, information, or advertising can be found at trade shows and tourist areas. Pens and highlighters with dispensers attached to or integrated therein for dispensing adhesive backed writing sheets, such as tape flags are also commercially available.

US 2017/0239976 discloses a multi-purpose combination writing instrument that can perform several such functions in a single device. It discloses a multi-purpose combination writing instrument comprised of two casing members with two writing instruments attached to each casing member, where the casing members are connected to one another by a retractable unwinding tool, where a casing member can have a pad of adhesive stickers or tape flag dispensers attached thereto. The unwinding tool can also function as a retractable banner, and can have on it a design, such as a logo, art work, and/or literature.

While the foregoing products are useful, there is a desire to those skilled in the art for continued innovation of multi-purpose combination writing instruments that accommodate such tools and writing instruments in a single device.

SUMMARY

The present invention pertains to a multi-purpose combination writing instrument designed to hold multiple writing instruments and tape flags. In one aspect, the present invention also pertains to such a multi-purpose combination writing instrument which also contains a retractable banner.

The multi-purpose combination writing instrument of the invention comprises at least three individual writing instruments, each individual writing instrument comprising: a barrel having a proximal end and a distal end; a base having opposing first and second ends, the first end of the base comprising at least three receivers, wherein each receiver is adapted to receive the proximal end of the barrel of a corresponding individual writing instrument, and the second end of the base having at least three tape flag platforms disposed therein; and a cap rotatably mounted on the second end of the base over the at least three tape flag platforms, wherein an opening in the cap provides access to one tape flag platform at a time as it rotates around the second end of the base.

An embodiment of the multi-purpose combination writing instrument described above further comprises a panel mounted on a side of the base over an opening in the base, the panel having an interior surface and an exterior surface, and a slot extending through the panel from the interior surface to the exterior surface; an oblong bar; and a banner comprising a retracted end under the interior surface of the panel and an extended end extending through the slot and attached to the oblong bar above the exterior surface of the panel.

BRIEF DESCRIPTION OF THE DRAWINGS

Figures of the present invention can be more clearly understood from the following detailed description considered in conjunction with the following drawings, in which the same reference numerals denote the same elements throughout.

DETAILED DESCRIPTION

Figure 1:
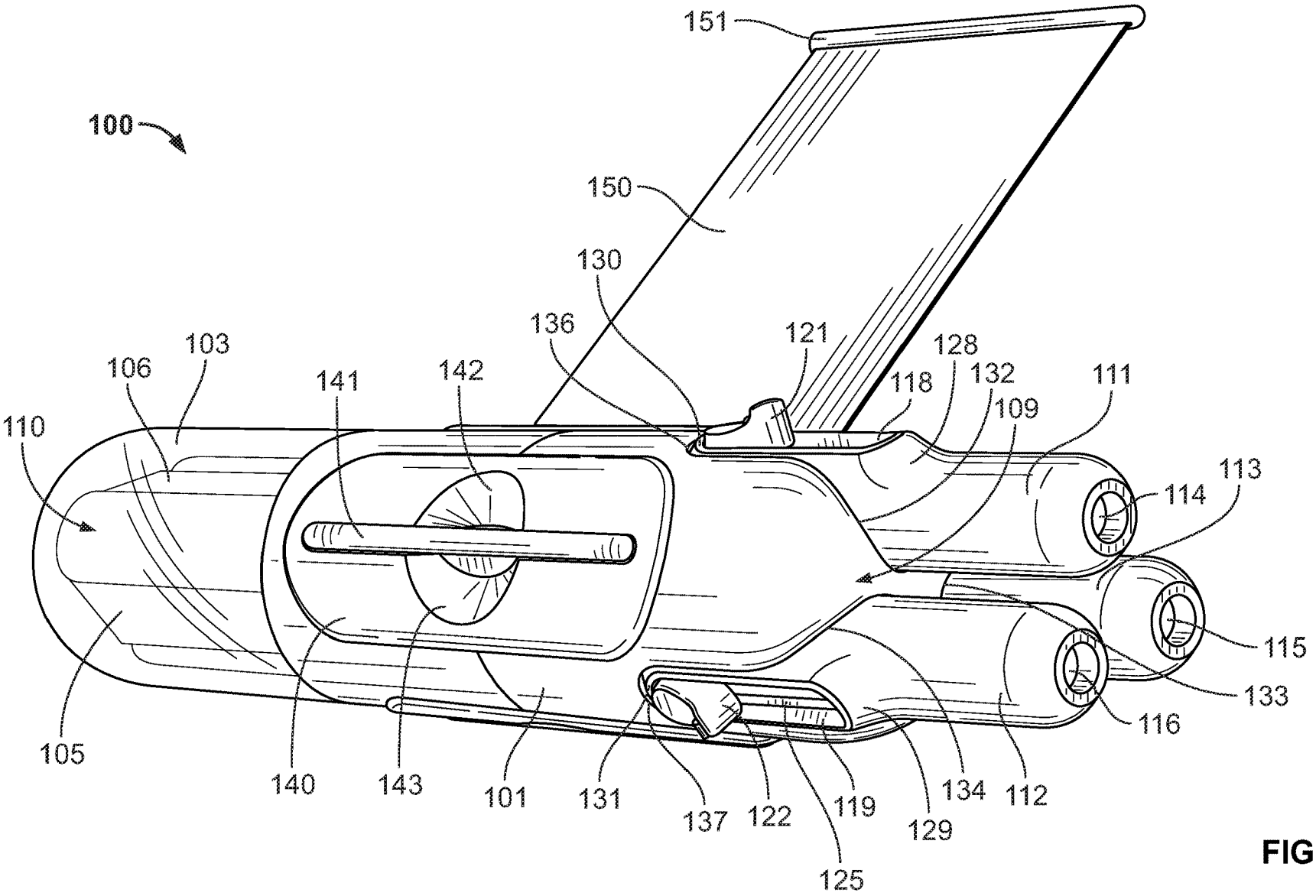
FIG. 1 is a front left perspective view of an exemplary multi-purpose combination writing instrument of the present invention with banner extended.

As used herein, the word "a" or "plurality" before a noun represents one or more of the particular noun.

For the terms "for example" and "such as," and grammatical equivalences thereof, the phrase "and without limitation" is understood to follow unless explicitly stated otherwise. As used herein, the term "about" is meant to account for variations due to experimental error. All measurements reported herein are understood to be modified by the term "about," whether or not the term is explicitly used, unless explicitly stated otherwise. As used herein, the singular forms "a," "an," and "the" include plural referents unless the context clearly dictates otherwise.

Unless otherwise defined, all technical and scientific terms used herein have the same meaning as commonly understood by one of ordinary skill in the art to which this invention belongs. Methods and materials are described herein for use in the present invention; other, suitable methods and materials known in the art can also be used. The materials and methods are illustrative only and not intended to be limiting. All publications, patent applications, patents, sequences, database entries, and other references mentioned herein are incorporated by reference in their entirety. In case of conflict, the present specification, including definitions, will control.

This invention has the advantage of allowing the user to carry one multi-purpose combination writing instrument with multiple individual writing instruments and multiple tape flag pads in a single device. When the multi-purpose combination writing instrument also includes a retractable banner, it further adds to the utility of the device.

The term "tape flag" as used herein refers to adhesive backed writing sheets that are removably attached to one another, and which can be attached to other surfaces when pressed thereon. The tape flags can be made of paper or other suitable writing material. Adhesive backed writing sheets suitable for use as tape flags in the present invention are commercially available under various brand names, including Post-It® Flags (3M Corp). Each tape flag platform of the present device can have the same or a different colored tape flag pad attached thereto, depending upon the needs of the user of the device.

The multi-purpose writing instrument can contain, for example, multiple different colors of pens and pads of different colored tape flags all within a single device. The user can assemble a different mix of writing tools according to the user's preference. Because of its many functions, it is also a time saving writing device meeting the needs of the user, such as a student or professional. The multi-purpose writing instrument is designed to make it easy to replace the individual writing instruments and pads of adhesive paper.

In certain embodiments, each individual writing instrument further comprises a marking element contained in the barrel, and orifice in the distal end of the barrel adapted to receive the marking element, and a side knob in an opening in a side of the barrel. Each individual marking element is independently selected from a pencil lead, an ink marking element, a fluid marking element, or a stylus for a tablet computer or other electronic device. In some embodiments, all of the individual writing instruments are highlighter pens, in which case the writing elements are fluid marking elements. When the marking element is an ink marking or fluid marking element, the barrel further contains a reservoir connected to the marking element. The reservoir of an ink marking element is designed to contain ink, while the reservoir of a fluid marking element contains marking fluid. The reservoir attached to a fluid marking element or ink marking element can contain the same color or a different color ink or marking fluid from the marking elements of other individual writing instruments in the multi-purpose combination writing instrument of the invention.

The side knob described above is part of a retraction system designed for retracting and extending a writing element contained in the barrel in and out through the orifice in the distal end of the individual writing instrument. Any type of retraction system operated by a side knob could be used in the individual writing instruments of the invention. For example, the side knob could be a wheel, a slidable knob, or lever. In one embodiment, a side of the opening in the side of the barrel has an inner edge forming a rail parallel to an axis of the base, wherein the side knob is adapted to slide along the rail, thereby moving the individual writing element through the orifice in the distal end of the barrel. In an embodiment, the distal end of the rail terminates in a ledge, and a groove between the ledge and a distal end of the opening in the side of the barrel accommodates a pin extending from the inner surface of the side knob, when inserted therein to reversibly lock the side knob in a forward position, where the individual writing element extends out the orifice in the proximal end of the barrel. In an embodiment, the retraction mechanism also includes a coiled spring, which is compressed when the side knob is in a forward position, and which relaxes and causes the writing element to retract from the orifice when the pin is extracted from the groove. When the writing element is a fluid marking element, the retraction mechanism further includes a marking fluid drying prevention cover, such as a sleeve covering the writing element.

The individual writing instruments are preferably identical in size and shape, enabling them to be readily interchanged and replaced. The barrels of the writing instruments can be color coded to indicate the color of ink or writing fluid contained in the reservoir, or to indicate the type of writing element contained therein.

The first end of the base is adapted to hold at least three individual writing instruments. In one embodiment the base is adapted to hold 3, 4, or 5, in another 3 or 4, and in another 3 individual writing instruments. The base can be of any size. In some embodiments, the base is between about 4 to about 7 inches long. In some embodiments, the base is between about 3 to about 6 inches wide. Other sizes are also contemplated. The base is preferably sufficiently compact to be grasped comfortably between the forefinger and thumb of a human user and manipulated to write with one of the writing instruments inserted in the base.

Each receiver in the first end of the base is adapted to receive the proximal end of the barrel of an individual writing instrument. In an embodiment of the invention, each barrel is press fit into the corresponding receiver, with the interior surface of the receiver in contact with an outer surface the barrel of the individual writing instrument. In an embodiment of the invention, each receiver is adapted to hold each individual writing instrument in a position parallel to an axis of the base running from the center of the first end to the center of the second end of the base. In one embodiment, an opening in the side of the barrel of an individual writing instrument containing the side knob has a raised lip, and a proximal side of the raised lip fits into a groove in an outer edge of the receiver adapted to receive the raised lip. In that embodiment, the raised lip can prevent the individual writing instrument from sliding further into the base when present in the receiver. In that embodiment the groove and raised lip also act to prevent the individual writing instrument from rotating while in the receiver, thereby maintaining each individual writing instrument in a position where the side knob is readily accessible. Each individual writing instrument can differ in shape. In one embodiment all of the individual writing instruments are identical in shape and size.

The second end of the base is adapted to have the cap rotatably mounted thereto. In an embodiment, the cap is connected to a cap connector, a circular region around the second end of the base. In an embodiment, the inner surface of the mouth of the cap is press fit to the outer surface of the cap connector. The cap can be rotated by turning it in place, or by removing, rotating, and replacing it.

The second end of the base comprises at least three tape flag platforms disposed therein. In one embodiment, the second end of the base includes 3 to 5 tape flag platforms, in another 3 or 4 tape flag platforms. In another embodiment, the number of tape flag platforms matches the number of individual writing instrument receivers in the first end of the base. In an embodiment, the tape flag platforms are positioned between the cap connector and the terminus of the first end of the base. The tape platforms are positioned so that a pad of tape flags mounted on only one tape flag platform can be accessed at a time through the opening in the cap, while pads of tape flags on the other tape flag platforms are covered. In one embodiment, the tape flag platforms are distributed an equidistance from one another around the radius of the second end. Each tape flag platform preferably comprises a flat surface to which a tape flag pad can be securely attached. In an embodiment, an indentation between each tape flag platform and the terminus of the second end further facilitates removal of one tape flag at a time when a tape flag pad is mounted on a tape flag platform. In that embodiment, the opening in the side of the cap is further adapted to allow access to the indentation near the terminus.

In another embodiment, the base of the multi-purpose combination writing instrument further comprises at least one mounted panel with a retractable banner. In one embodiment, the retractable banner is made of a material which causes it to roll into a scroll configuration in its relaxed state. In that embodiment, the retracted end of the banner is in a scroll configuration under an inner surface of a panel while an extended end of the banner extends out a slot in the panel where it is connected to an oblong bar. In an embodiment, the oblong bar is in contact with the outer surface of the panel when the banner is fully retracted. As the oblong bar is pulled outward away from the outer surface of the panel, the retracted end of the banner bar unwinds from the scroll and extends through the slot. In preferred embodiments, where the banner is in a scroll configuration in its relaxed state, it will retract automatically, wrapping back onto the scroll as the oblong bar is moved back toward the outer surface of the panel without the use of any spring or other mechanism designed to promote wrapping of the scroll. In one embodiment, the retracted end of the banner is connected to a retention cylinder to prevent the banner from being pulled all the way out of the slot when fully extended. In that embodiment, the retracted end of the banner wraps around the retention cylinder.

The banner can be imprinted with a design on either or both sides, such as a logo, work of art, piece of literature, and/or useful information, such as a map or information about technology, cosmetics, the environment, sports, or other topics. The design can be placed on a piece of fabric or a sticker that is adhered to the surface of the banner. The design and/or information imprinted on or adhered to the banner are visible when the banner is extended.

The panel can be mounted over the opening in the side of the base using any attachment means, including an adhesive or clips extending from the surface of the panel into one or more openings in the base. The slot in the panel preferably runs parallel to an axis of the base when the panel is mounted on the base. In an embodiment, the slot is positioned in the center of the panel, and the panel is positioned between the closest two individual writing instruments, preferably an equidistance between the two individual writing instruments, to allow space in the interior of the base for the banner to retract. In an embodiment, the outer surface of the panel includes a cavity over the slot adapted to receive an inner surface of the oblong bar. That configuration enables the oblong bar to be more securely housed on the outer surface of the panel when the banner is fully retracted. Optional tabs on the outer edges of the cavity can extend over the outer surface of the oblong bar to further secure it in place when the banner is fully retracted. In an embodiment, the outer surface of the panel also includes an indentation on either side of the slot to facilitate grasping of the oblong bar, when the banner is retracted, so it can be pulled away from outer surface of the panel to extend the banner.

In one embodiment, the multi-purpose combination writing instrument optionally further comprises at least one other mounted panel with the same configuration as the one described above mounted over another opening in the side of the base. In one embodiment each opening in the side of the base with a panel mounted thereon is positioned an equidistance between two individual writing instruments.

In one embodiment, the multi-purpose combination writing instrument comprises at least one mounted panel with a retractable banner mounted over an opening in the side of the base, as described above, and at least one integrated panel with an oblong ridge having the same dimensions and surface structure as the oblong bar when the banner is retracted. When the mounted panel includes indentations in the surface of the panel on either side of the oblong bar, each integrated panel can also contain a similar indentation in the same position on either side of the oblong ridge. Each integrated panel with oblong ridge is preferably stamped or molded onto the surface of the base. In that embodiment, the integrated panel does not include a slot or banner associated therewith. The integrated panel with oblong ridge provides a balanced feel and extra grip when the multi-purpose writing instrument is used. The at least one mounted panel and any integrated panel can be any shape but is preferably rectangular or oval in shape. The at least one mounted panel and any integrated panel are preferably radially distributed around the surface of the base between the rotatably mounted cap and the first end of the base an equidistance apart from one another. In one embodiment, each mounted panel or integrated panel is located in a position on the base above an equidistance between two individual writing instruments. In one embodiment, any oblong bar and oblong ridge are parallel to an axis of the base running from the center of the first end to the center of the second end.

The base, individual writing instruments, panel, and oblong bar and any parts thereof can be made with any suitable material(s) by any known methods in the art, such as, for example, 3-D printing, injection molding, rapid prototyping, etc. Joining any two parts can be accomplished by any methods in the art using any suitable material(s). The multi-purpose combination writing instrument of this invention and its components can be of any suitable size and/or shape.

These and other embodiments of the invention are described below with reference to FIGS. 1-16, wherein like numerals are used throughout to denote like elements.

FIG. 1 illustrates an embodiment of a multi-purpose combination writing instrument 100 of the invention with a base 101 with a cap 103 rotatably mounted over a second end 110 of base 101. In this embodiment, the cap 103 is transparent. The second end 110 of base 101 has tape flag platforms inset in the side of the base at that end parallel to and spaced a uniform distance apart from one another. Tape flag pads 105 and 106 can be seen through the transparent surface of cap 103, which hide the surface of the corresponding flag tape platforms to which they are attached in this view. The distal end of a barrel of each of three individual writing instruments 111, 112, and 113 can be seen extending from the first end 109 of base 101. Orifices 114, 115, and 116 in the distal end of the barrel of each of the individual writing instruments 111, 112, and 113, respectively are each adapted to receive a marking element contained inside each barrel, not shown in this view. Openings 118 and 119 in the side the barrel of each individual writing instrument 111 and 112 have side knobs 121 and 122 disposed therein with the outer surface of each side knob extending outward above the surface of the respective opening. A rail 125 parallel to an axis of the base running from the first end 109 to the second end 110 of the base 101 can be seen inside opening 119 in the side of the barrel of individual writing instrument 112. Each side knob is adapted to be slid forward along a rail in the inside of the opening in the respective barrel. The side knob is part of a retraction mechanism whereby the tip of an individual writing instrument in the barrel of an individual writing instrument can be extended or retracted therefrom through the orifice in the distal end of the barrel. Another part of the retraction mechanism is a rail 125 in opening 119. Side knob 122 is adapted to slide forward along rail 125, engaging with the rest of the retraction mechanism to extend a writing element contained in the barrel of individual writing instrument 112 out through orifice 116. The outer surface of the barrel around the opening 118 and 119 in the side of the barrel of individual writing instruments 111 and 112, extends outward forming raised lip 128 and 129 respectively. A proximal end of each individual writing instrument extends into a corresponding receiver in the first end of the base 101, but only an outer edge 132, 133, and 134 of each receiver is visible. A proximal edge 130 and 131 of each raised lip 128 and 129 fits into a groove 136 and 137, respectively, in the outer edge of the corresponding receiver. The groove prevents the individual writing instruments from rotating and holds the side knob in a position on this embodiment of the multi-purpose writing instrument where it can easily be accessed when in use. One can also see an integrated panel 140 with an oblong ridge 141 and indentations 142 and 143 in the surface of integrated panel 140. The integrated panel 140, ridge 141, and indentations are features integrated into the base, which give the base a uniform feel and grip when in use. The oblong ridge 141 and integrated panel 140 are parallel to the axis of the base. One can also see banner 150 extending out the other side of the device, attached to oblong bar 151.

Figure 2:
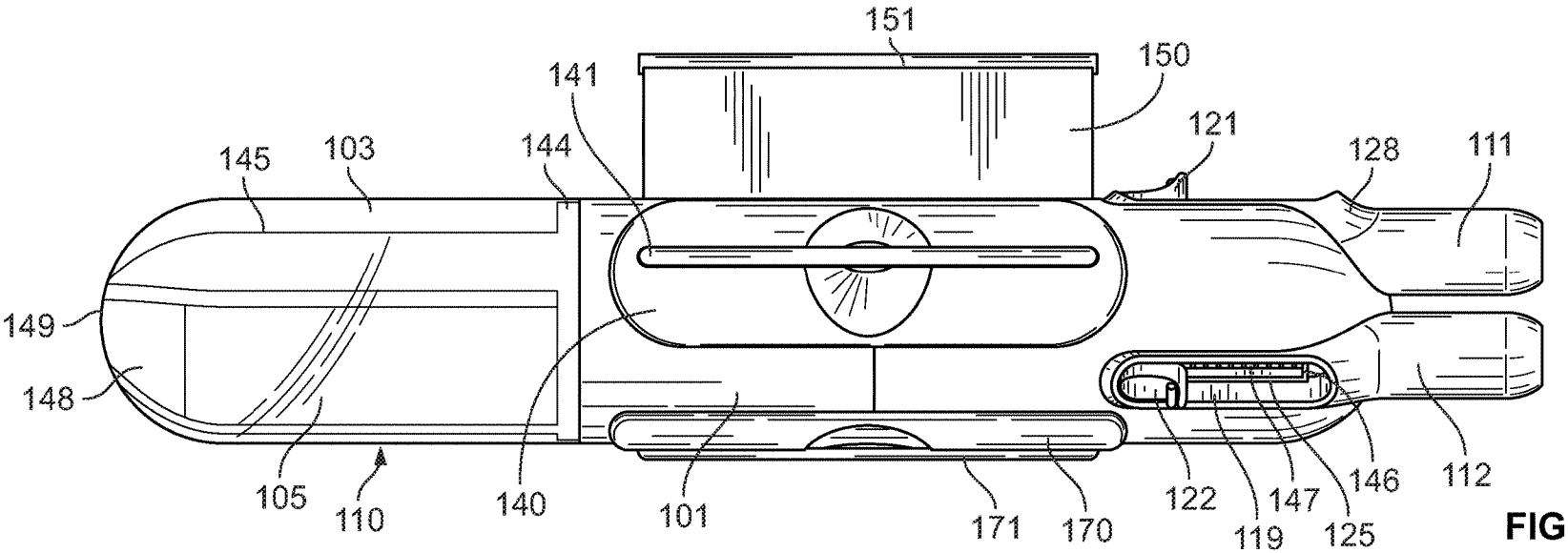
FIG. 2 is a left side view of the multi-purpose combination writing instrument of FIG. 1 with banner extended.

FIG. 2 is a left side view of the multi-purpose combination writing instrument of FIG. 1. Many of the same features identified in FIG. 1, above, can also be seen in this view, integrated panel 140, oblong ridge 141, individual writing instruments 111 and 112, opening 119 in the side of the barrel, side knobs 121 and 122, raised lip 128, cap 103, and tape flag pad 105. FIG. 2 also shows a few additional features of the device not seen in FIG. 1. For example, one can see part of a cap connector 144 through the surface of the cap 103, where cap connector 144 is a circular region around the second end 110 of the base above the surface of the tape flag platforms to which the inner surface of the mouth of cap 103 is rotatably attached. One can also see an edge of tape flag platform 145 and part of an indented surface 148 at the second end 110 of base 101 between an edge of tape flag pad 105 and the terminus 149 of the second end 110, through the surface of the transparent cap. The surface of tape flag platform 145 is hidden by tape flag 106 in FIG. 1. One can also see more of the retraction mechanism through opening 119 in the side of the barrel of individual writing instrument 112 in FIG. 2, including a ledge 146 and spring 147. The side of integrated panel 170 and of oblong ridge 171 (viewed more clearly in FIG. 7, below) can also be seen in this view.

Figure 3:
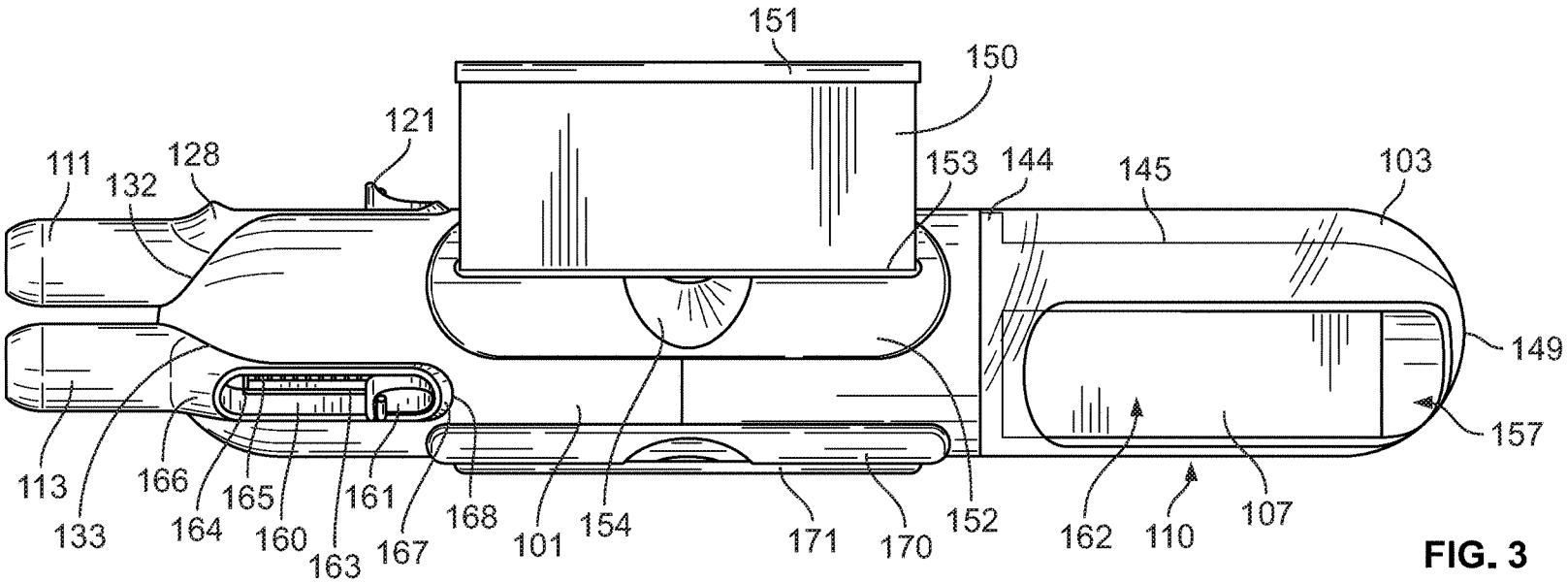
FIG. 3 is a right side view of the multi-purpose combination writing instrument of FIG. 1 with banner extended.

FIG. 3 is a right side view of the multi-purpose combination writing instrument of FIG. 1. In this view, one can see extended banner 150, which is connected on one end to oblong bar 151, extends outward from a slot 153 in mounted panel 152. An indentation 154 in the outer surface of the mounted panel 152 adjacent to the slot 153 can also be seen. Individual writing instruments 111 and 113 extend outward from the outer edges 132 and 133 of their respective receivers in base 101. One can also see an opening 160 in the side of the barrel of individual writing instrument 113, with side knob 161 disposed therein with the outer surface of side knob 161 extending outward above the surface of the opening. Side knob 161 is part of the same type of retraction system described and shown in FIG. 1. Other parts of the retraction system visible in this view include a rail 163, ledge 164, and spring 165. The outer surface of the barrel around the opening 160 in the side of the barrel of individual writing instrument 113 outward forming raised lip 166, and a proximal edge 167 of the raised lip 166 fits into a groove 168 in the outer edge of the corresponding receiver. One can also see the rotatable cap 103, with an edge of tape flag platform 145 visible through the transparent surface of the cap. One can also see an opening 162 in the cap positioned over tape flag pad 107, through which tape flags can be removed from tape flag pad 107. One can also see an indented surface 157 of base 101 that extends to the terminus 149 of second end 110 through opening 162. The indented surface 157 is designed to make it easier to remove tape flags from tape flag pad 107. Tape flag pad 107 is mounted on the surface of a tape flag platform, which is hidden from view by the tape flag pad. The cap 103 is rotatably connected to base 101 at cap connector 144. Cap 103 can be rotated to be positioned over any of the three tape flag pads at the second and 110 of the device. The opening only allows one to access one tape flag pad at a time, while it covers the other two tape flag pads. An edge of integrated panel 170 and oblong ridge 171 can also be seen in this view.

Figure 4:
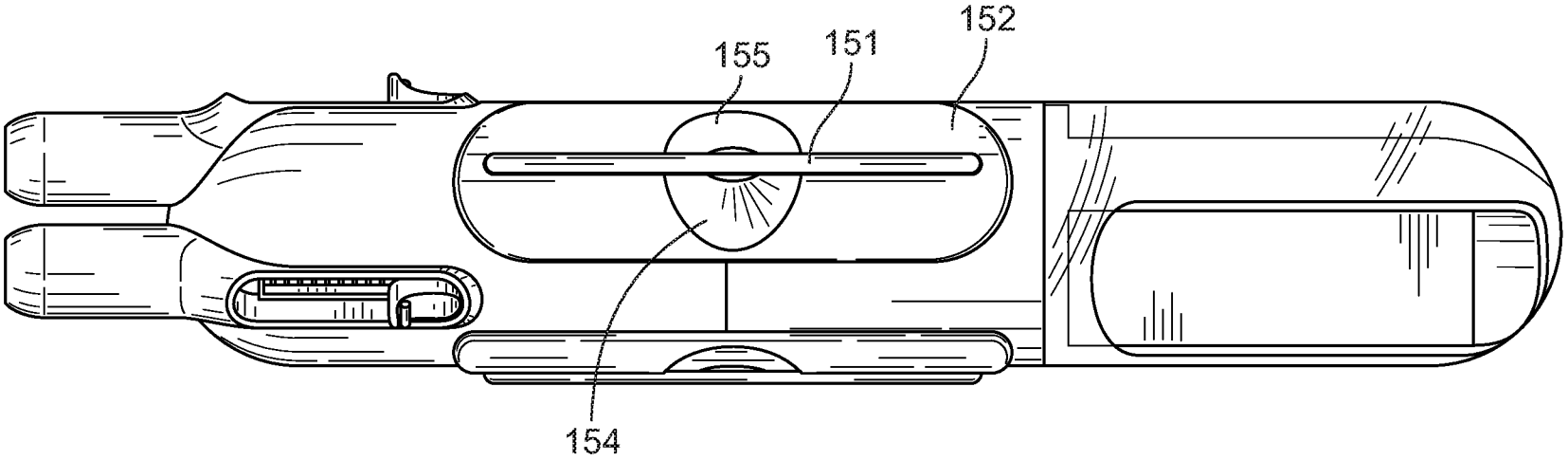
FIG. 4 is a right side view of the multi-purpose combination writing instrument of FIG. 1 with banner retracted.

FIG. 4 is the same view of the multi-purpose combination writing instrument shown in FIG. 3, but the banner is retracted and hidden from view in this figure, and the oblong bar is adjacent to the outer surface of mounted panel 152. Indentations 154 and 155 in mounted panel 152 are designed to facilitate grasping of the oblong bar 151 when in this position, so the oblong bar can be pulled outward from the surface of the panel and the retractable banner extended, as shown FIG. 3.

Figure 5:
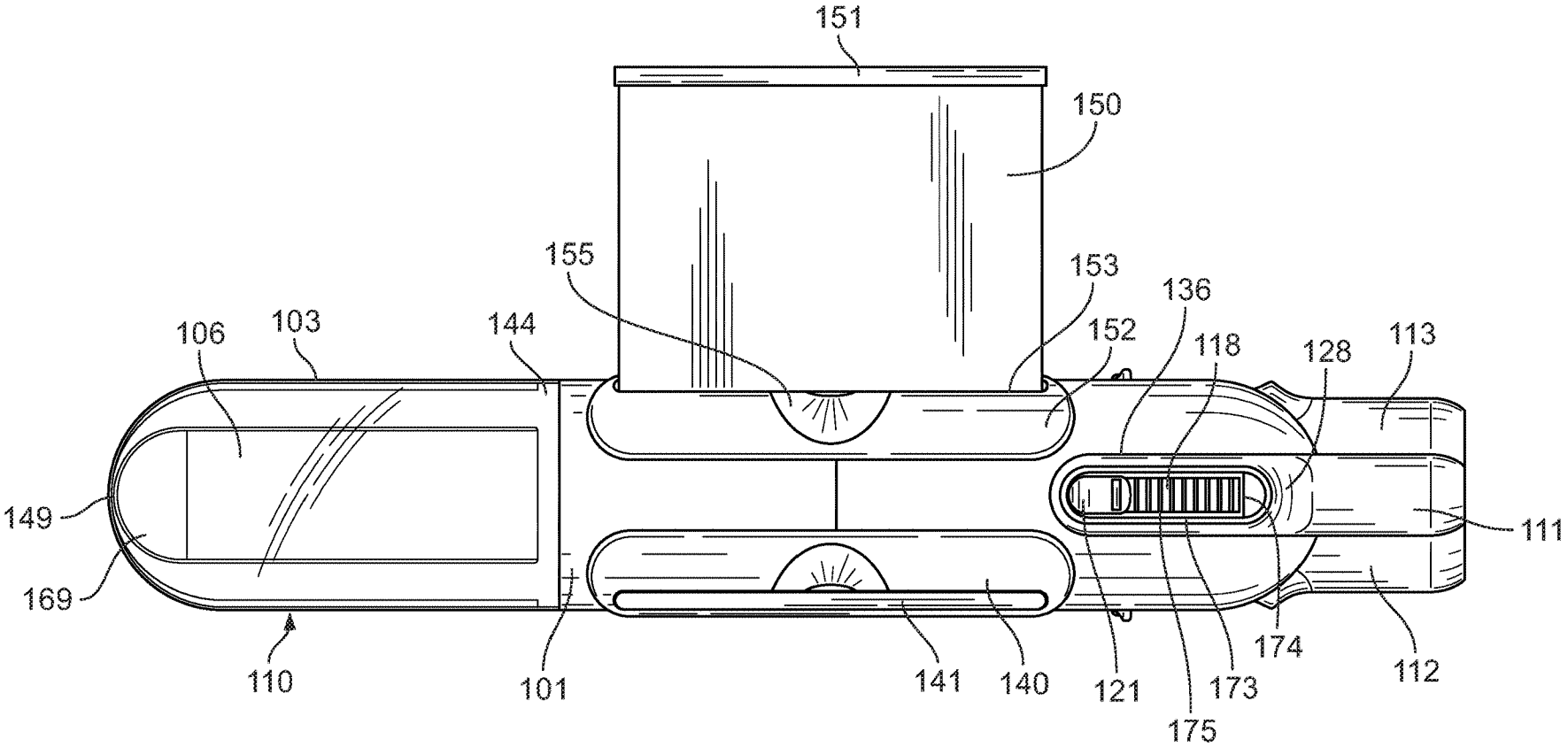
FIG. 5 is a top view of the multi-purpose combination writing instrument of FIG. 1 with banner extended.

FIG. 5 is a top view of the multi-purpose combination writing instrument of FIG. 1, with banner 150 shown attached to oblong bar 151 extending from slot 153 in panel 152, with indentation 155 in the panel 152. Tape flag pad 106, cap connector 144, and part of an indented surface 169 of base 101 extending from under tape flag pad 106 to the terminus 149 of second end 110 can be seen through the transparent surface of cap 103. One can also see other features described in previous figures, including the proximal ends of individual writing instruments 111, 112, and 113, opening 118 in the side of the barrel of individual writing instrument 111 with side knob 121 disposed therein, integrated panel 140 and oblong ridge 141. Additional features of other components of the retraction assembly of that individual writing instrument are also visible in FIG. 5, including rail 173, ledge 174, and spring 175, raised lip 128 and groove 136.

Figure 6:
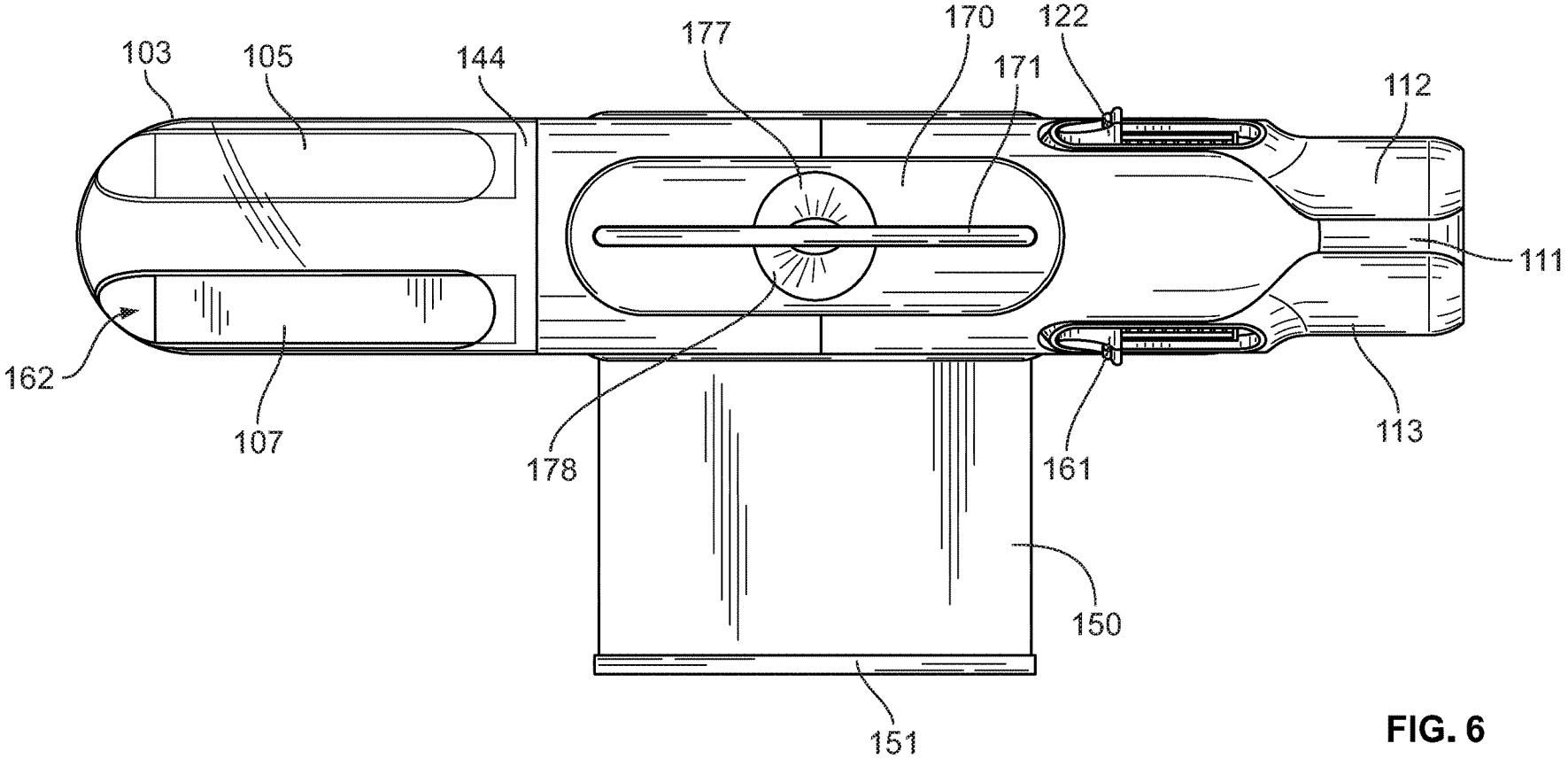
FIG. 6 is a bottom view of the multi-purpose combination writing instrument of FIG. 1 with banner extended.

FIG. 6 is a bottom view of the multi-purpose combination writing instrument of FIG. 1. In this view one can see integrated panel 170 with oblong ridge 171, and indentations 177 and 178 in the surface of the integrated panel on either side of the oblong ridge. Integrated panel 170, oblong ridge 171, and indentations 177 and 178 are aligned in the same direction on the base 101 and are the same shape and size as integrated panel 140 oblong ridge 141, and indentations 142 and 143 shown in FIG. 1. Other features and components visible in FIG. 6 are described in relation to other FIGs above, including individual writing elements 111, 112, and 113, side knobs 122 and 161, cap connector 144 and cap 103. Tape flag pad 105 can be seen through the surface of cap 103, while tape flag pad 107 can be seen through opening 162 in cap 103, through which tape flags can be removed from the tape pad, as described above.

Figure 7:
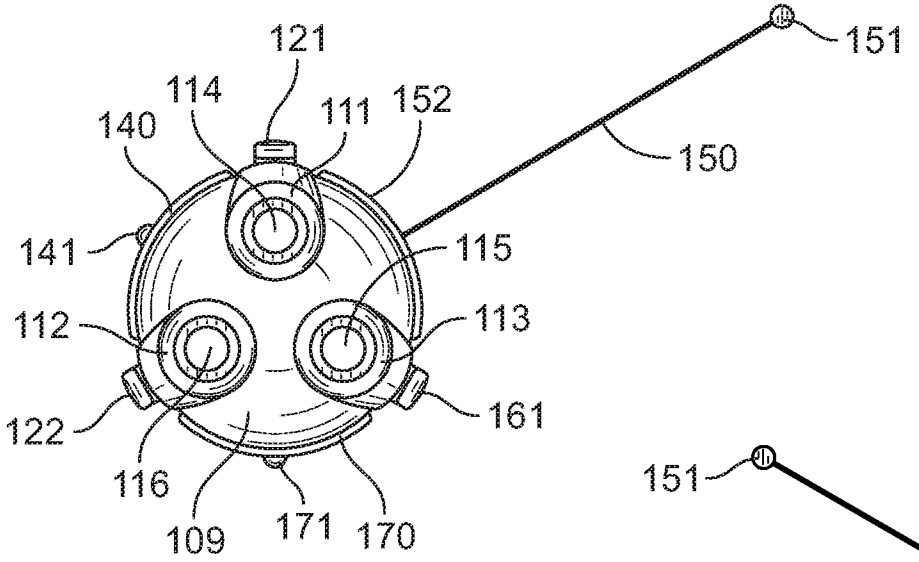
FIG. 7 is a front view of the multi-purpose combination writing instrument of FIG. 1 with banner extended.

FIG. 7 is a front end view of the multi-purpose combination writing instrument of FIG. 1, showing the first end 109 of the base, with a front view of orifices 114, 115, and 116 in individual writing instruments 111, 112, and 113, respectively, with side knobs 121, 122, and 161 extending outward from the surfaces of each individual writing instrument, respectively. One can also see the front edge of mounted panel 152, integrated panels 140 and 170, and raised oblong ridges 141 and 171. The front edge of banner 150 can be seen extending outward from mounted panel 152, with the end of banner 150 attached to the oblong bar 151.

Figure 8:
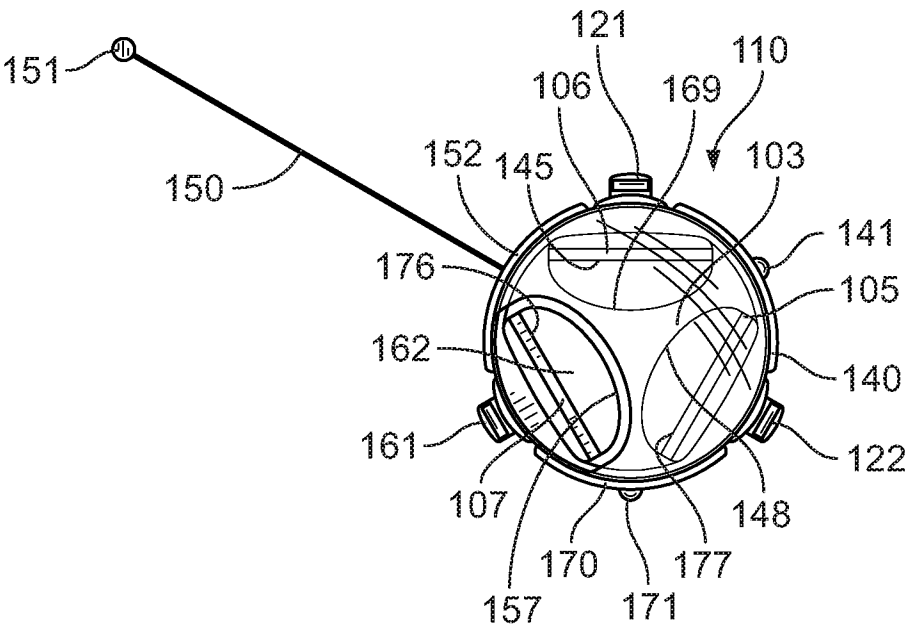
FIG. 8 is a rear view of the multi-purpose combination writing instrument of FIG. 1 with banner extended.

FIG. 8 is a back end view of the multi-purpose combination writing instrument of FIG. 1, showing the second end 110 of the base with cap 103. An edge of each of tape flag platforms 145, 176, and 177, with an edge view of each of tape flag pads 106, 107, and 105 attached to the surface of each tape flag platform, and indented surfaces, respectively. The edges of indented surfaces 148, 157, and 169 can also be seen. Tape flag pad 107 can be seen through opening 162 in cap 103, while the cap covers the other two tape flag pads. From this view, one can see how each indented surface can make it easier to insert a finger into opening 162 to remove a tape flag from a tape flag pad, when the opening is positioned over a given tape flag pad. One can also see the back edge of extended banner 150 and oblong bar 151 extending outward from mounted panel 152, the back edges of integrated panels 140 and 170, with a back view of oblong ridges 141 and 171, and side knobs 121, 122, and 161.

Figure 10:
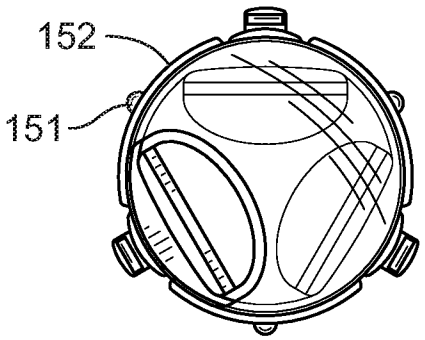
FIG. 10 is a rear view of the multi-purpose combination writing instrument of FIG. 1 with banner retracted.
Figure 9:
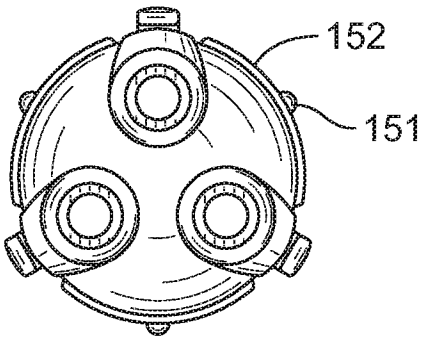
FIG. 9 is a front view of the multi-purpose combination writing instrument of FIG. 1 with banner retracted.

FIG. 9 is the same view of the multi-purpose combination writing instrument as FIG. 7, with the banner 150 retracted, and only the outer surface of the oblong bar 151 showing above the edge of panel 152. FIG. 10 is the same view of the multi-purpose combination writing instrument as FIG. 8, with the banner 150 retracted, and only the outer surface of the oblong bar 151 showing above the edge of panel 152. Both FIGS. 9 and 10 show that the outer surface of the multi-purpose combination writing instrument has a uniform surface structure when the banner 150 is retracted, making it easy to grasp and use.

Figure 11:
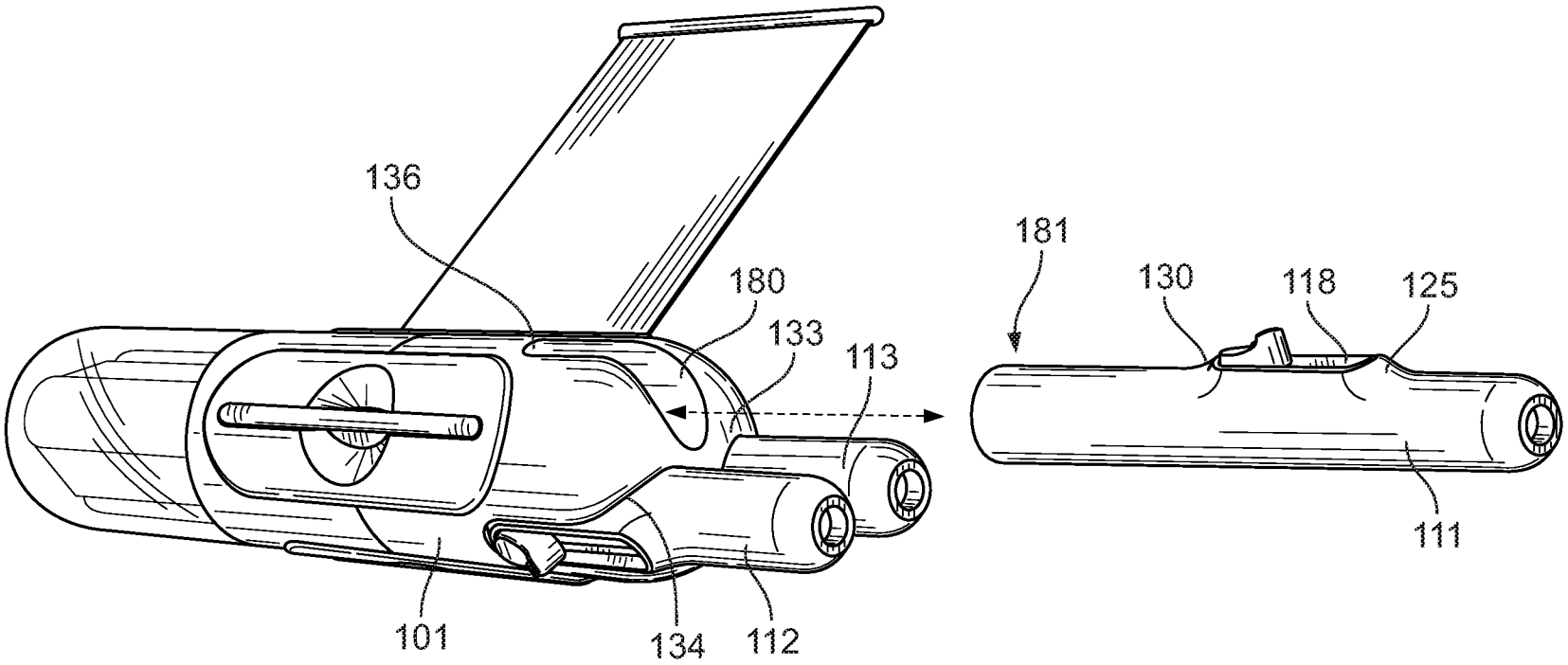
FIG. 11 is a perspective view of the multi-purpose combination writing instrument of FIG. 1 with an individual writing instrument removed from the base.

FIG. 11 is a side perspective partially exploded view of the multi-purpose combination writing instrument of FIG. 1, wherein individual writing instrument 111 has been removed from base 101, to show receiver 180 adapted to receive the proximal end 181 of individual writing instrument 111 when inserted therein. The interior surface of receiver 180, not all of which is shown, is adapted to fit around the outer surface of the individual writing instrument 111 like the cuff of a tight fitting sleeve, and to be in press fit connection therewith when individual writing instrument 111 is inserted therein. One can also see that raised lip 125 extends all the way around opening 118 in the side of the barrel of individual writing instrument 111. As noted above, the proximal edge 130 of the raised lip engages groove 136 in the edge of receiver 180 when inserted therein, as shown in FIG. 1, above. The groove 136 prevents the individual writing instrument 111 from sliding further into base 101 or rotating when inserted therein. Base 101 also includes corresponding receivers for individual writing instruments 112 and 113, which are shown inserted therein with the proximal end of each individual writing instrument 112 and 113 extending therefrom. Only an outer edge 133 and 134 of those two corresponding receivers can be seen. However, in the embodiment of the invention illustrated in FIG. 7, the structure of individual writing instrument 111 is representative of all three individual receivers in FIG. 7, and the structure of receiver 180 is representative of the structure of all three receivers in the first end of base 101.

Figure 12:
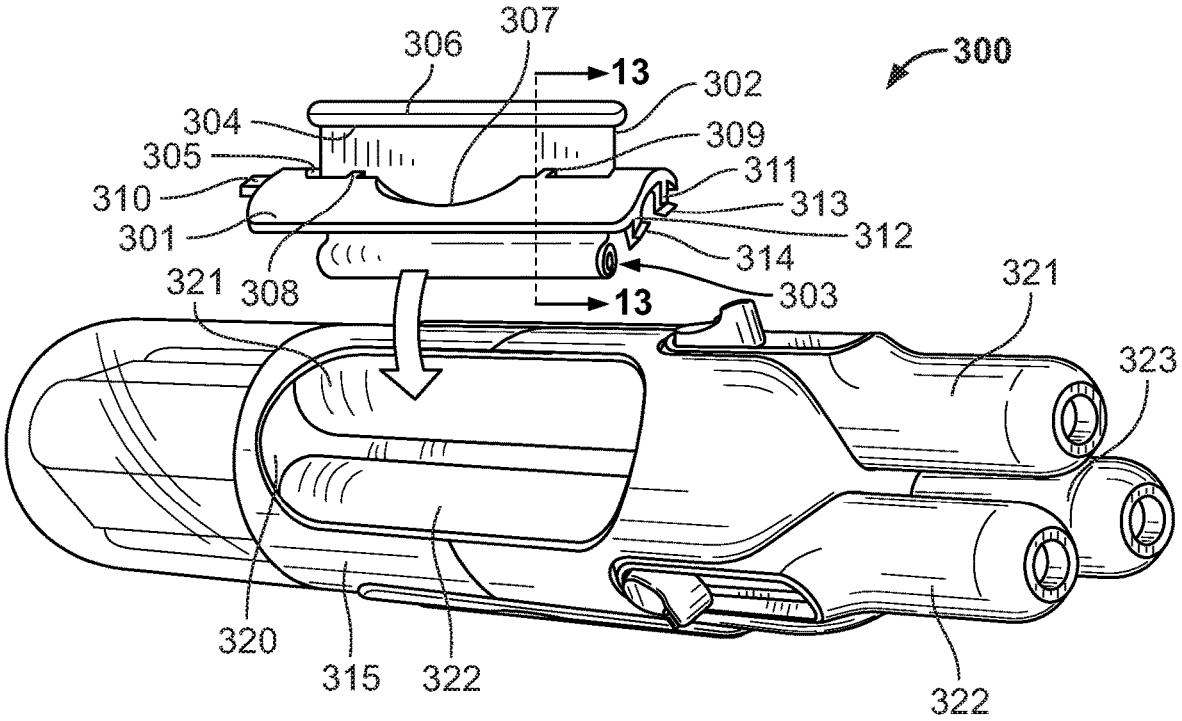
FIG. 12 is a perspective view of an exemplary multi-purpose writing instrument of the invention with a mounted panel removed from the base.

FIG. 12 shows exemplary multi-purpose combination writing instrument 300 with panel 301 removed to show banner 302 in a partially extended configuration with a retracted end 303 in a scroll configuration under the interior surface of panel 301. An extended end 304 of the banner 302 extends through slot 305 in panel 301, and is attached to oblong bar 306 positioned above the outer surface of panel 301. An indentation 307 in the outer surface of panel 301 extending into the slot 305 and a similar indentation not visible in that view on the other side of the banner are designed to enable one to easily grasp oblong bar 306 when banner 302 is fully retracted, so one can then pull the oblong bar 306 outward away from the outer surface of the panel to uncoil at least part of the retracted end of the banner and extend it. Tabs 308 and 309 extend from the outer surface of panel 301 into slot 305. Those tabs and corresponding tabs not visible in this view on the other side of the banner are designed so the oblong bar can be snapped under the tabs to secure the oblong bar when the banner is fully retracted. The tabs provide an optional way to secure an oblong bar to a panel.

Multi-purpose combination writing instrument 300 is an embodiment of the multi-purpose combination writing instrument 100 illustrated and described in the previous FIGs, above, and illustrates how corresponding panel 152 of that device can also be mounted on the corresponding base and how corresponding banner 151 can be mounted therein. However, panel 152 does not include tabs corresponding to tabs 308 and 309.

FIG. 12 also shows an opening 320 in the side of the base 315 of multi-purpose combination writing instrument 300 adapted to fit the outer edge of panel 301 when mounted thereon. Tongue 310, and clips 311 and 312 in panel 301 provide means for mounting the panel in the opening. Specifically, tongue 310 extends from a proximal edge of panel 301 parallel to the surface of the panel, and is configured to fit through opening 320 and contact an interior surface of the base when panel 301 is mounted thereon. Clips 311 and 312 extend downward from an opposing distal edge of panel 301, and include ledges 313 and 314 extending outward from the end of each of clips 311 and 312, respectively. The clips are configured to extend through the opening 320 and engage with an edge of opening 320, while the ledge engages with the inner surface of base 315 when panel 301 is mounted thereon. Specifically, panel 301 is designed to be mounted on base 315 by inserting tongue 310 through the opening adjacent to a proximal edge of opening 320, and then lowering the other side of panel 301 until clips 311 and 312 extend through opening 320 and snap into place therein. A banner can be mounted in a panel such as panel 301 of the invention before the panel is mounted on a base, by threading one end of a retracted banner from under the interior surface of the panel, out through the slot, and attaching it to an oblong bar on the outer surface of the panel. The distal end of the barrel of each of three writing instruments 321, 322, and 323 can be seen extending from the outer edge of corresponding receivers in the first end of base 315. A proximal end of the barrel of individual writing instruments 321 and 322 can be seen through opening 320 extending into the interior of the base. Other unnumbered features of the device are the same as those illustrated in corresponding device 100, above.

Figure 13:
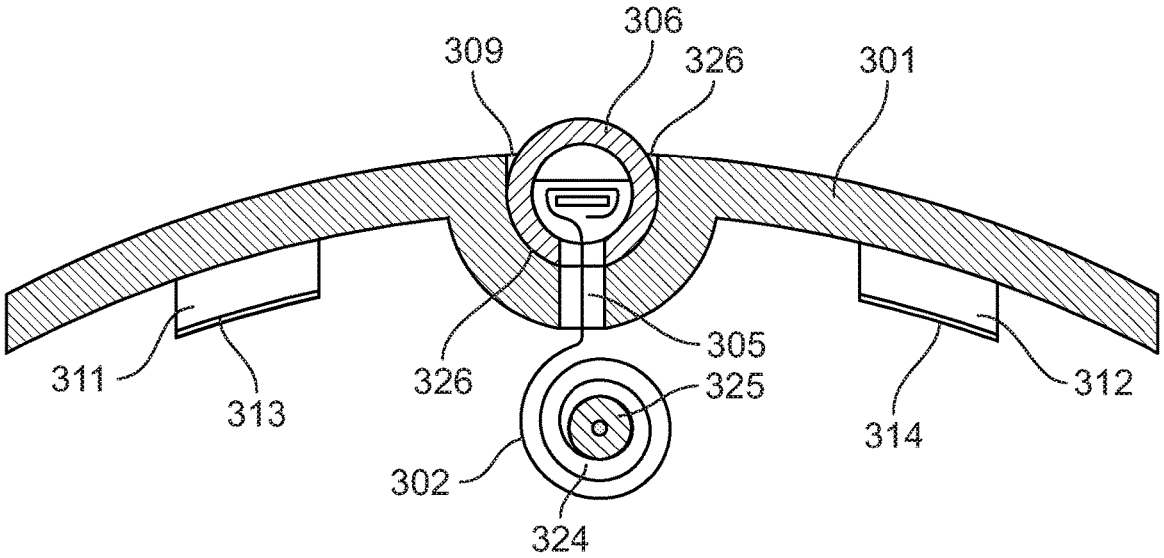
FIG. 13 is a side view of the mounted panel of FIG. 12 taken along line 13-13.

FIG. 13 provides a view of an embodiment of a cross section of panel 301 taken along line 13 indicated in FIG. 12. Clips 311 and 312 extend downward from the interior surface and include ledges 313 and 314, respectively. One end of banner 302 is shown coiled around in a scroll configuration under the interior surface of panel 301 with the retracted end 324 of the banner attached to retention cylinder 325. The other end of banner 302 extends through slot 305 where it is attached to oblong bar 306. Retention cylinder 325 prevents banner 302 from being pulled all the way out through slot as the banner is extended by pulling oblong bar 306 away from the outer surface of panel 301. In this illustrated embodiment, retention cylinder 325 is not attached to any winding mechanism, such as a spring. In the embodiment of panel 301 illustrated in FIG. 13 the outer surface of the panel is indented to form a cavity 326 adapted to receive an inner surface of the oblong bar 306, and tabs 309 and 326 extend from the outer surface the panel 301 to contact either side of the outer surface of oblong bar 306 to hold it securely in place in cavity 326.

Figure 14:
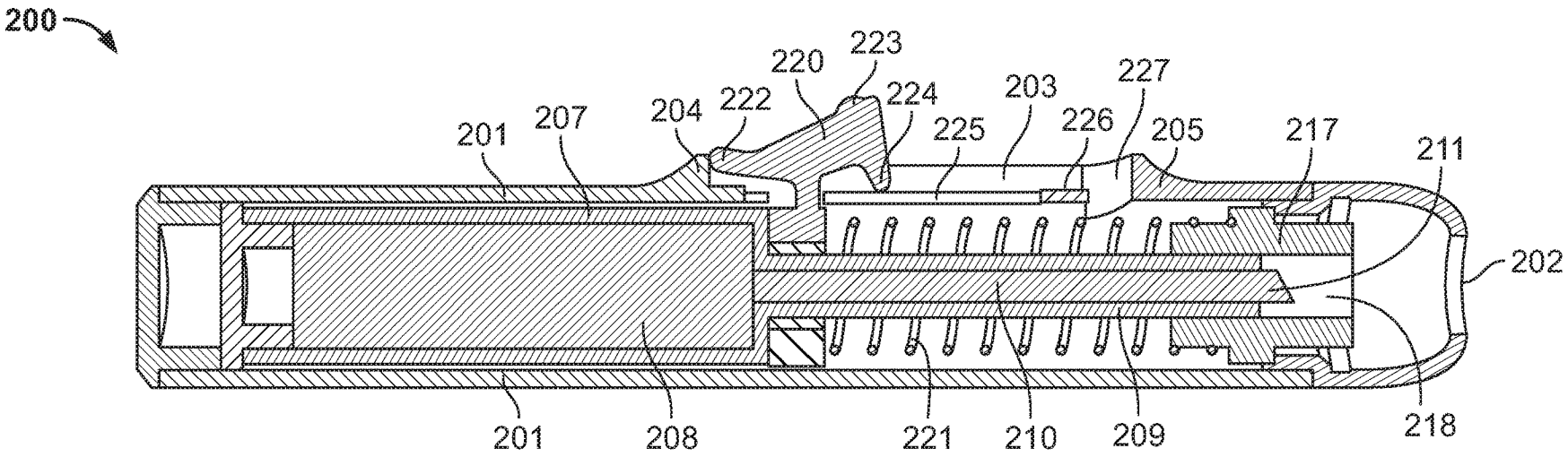
FIG. 14 is a cross-section view of the removed individual writing instrument of FIG. 11 in a retracted configuration.
Figure 15:
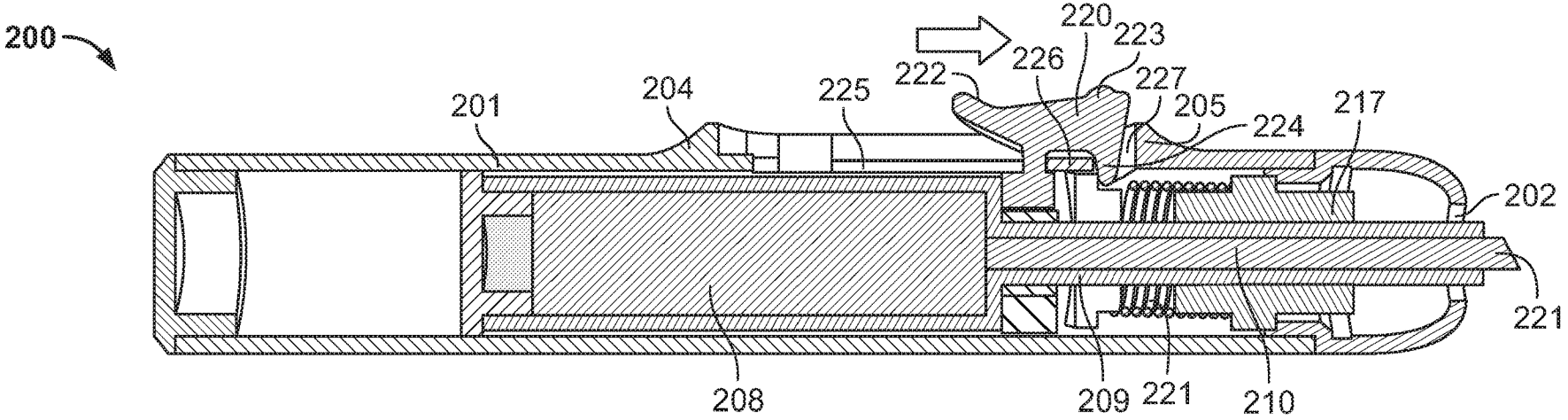
FIG. 15 is a cross-section view of the removed individual writing instrument of FIG. 11 in an extended configuration.

FIGS. 14 and 15 provide a side cross section view of individual writing instrument 200 illustrating an exemplary retraction mechanism in two different configurations, in a retracted and extended configuration. The retraction mechanism illustrated in these two figures can be used in the individual writing element components of a multi-purpose combination writing instrument of the invention, such as individual writing instruments 111, 112, or 113 of the device illustrated in FIGS. 1-11, above. The same elements can be found in both figures, and are identified using the same numbers, although the configuration of some of the elements differs.

Individual writing instrument 200 in FIGS. 14 and 15 is comprised of a barrel 201 with orifice 202 in the distal end of the barrel 201 and an opening 203 in the side of the barrel with a proximal raised lip 204 and distal raised lip 205 in the barrel surface on opposing ends of the opening 203. The interior of the barrel contains a reservoir 208 with a marking element 210 connected thereto through which marking element fluid or ink contained in reservoir 208 can enter marking element 210. The marking element 210 shown in these two figures is a highlighter pen writing element, and the reservoir contains liquid marking fluid, although the fluid is not shown in these views. However, the same type of retraction mechanism could be used for other types of marking elements, such as a ball point pen, in which case the reservoir would be filled with ink instead of liquid marking fluid. The marking element 210 is contained in a shaft 209, which is connected to the reservoir 208 at a proximal end. The tip 211 of the marking element extends out the opposing distal end of the shaft 209. The barrel 201 also contains a guide 217 with a channel 218 running through it. In the retracted configuration shown in FIG. 14, the distal end of the shaft 209 is positioned in channel 218 of the guide 217. The channel 218 aligns the shaft 209 with the orifice 202 in the distal end of the barrel 201, so the shaft 209 and tip 211 of the marking element can extend out of orifice 202 when slid forward as shown in an extended configuration in FIG. 15. A side knob 220 in opening 203 engages with the shaft to move it forward and back through the orifice 202. The side knob 220 is connected to a casing of the reservoir 207 and to the shaft 209. A spring 221 is wrapped around the shaft 209 between the side knob 220 and the guide 217. The side knob 220 includes a release lever 222 and an engagement button 223 in the outer surface, and a pin 224 protruding from the inner surface of the side knob 220. FIG. 14 shows the writing instrument with the marking element retracted, with the side knob 220 in contact with the proximal raised lip 204 and the spring in an open position. The side knob 220 slides along a rail 225 in the side of the opening in the side of the barrel when it is pushed toward the distal end of the barrel 201 until it comes into contact with ledge 226, at which point the engagement button 223 can be pressed to lower the pin 224 over the ledge 226 into a groove 227 between the ledge 226 and the distal raised lip 205, thereby locking the side knob in that position. As the side knob is moved toward the distal end of the barrel, the spring 221 compresses and the shaft 209 moves toward and out the opening 202 in the distal end of the barrel 201. In the extended configuration illustrated in FIG. 15, the side knob 220 is adjacent to the distal raised lip 205 of the barrel and pin 224 positioned over the ledge 226 in the groove 227, locked in that position. When the release lever 222 is pressed when the device is in that configuration, pin 224 is lifted out of the groove 227, thereby releasing the tension on the compressed spring 221 which moves the side knob 220 back to the position of the retracted configuration shown in FIG. 14.

While the present invention has been disclosed in connection with exemplary embodiments thereof, it should be understood that other embodiments may fall within the spirit and scope of the invention.

The invention claimed is:

1. A multi-purpose combination writing instrument comprising:

at least three individual writing instruments, each individual writing instrument comprising a barrel having a proximal end and a distal end;

a base having opposing first and second ends, the first end of the base comprising at least three receivers, wherein each receiver is adapted to receive the proximal end of the barrel of a corresponding individual writing instrument, and the second end of the base having at least three tape flag platforms disposed therein; and a cap rotatably mounted on the second end of the base over the at least three tape flag platforms, wherein an opening in the cap provides access to one tape flag platform at a time as it rotates around the second end of the base.

2. The multi-purpose combination writing instrument of claim 1, each individual writing instrument further comprising a marking element contained in the barrel, an orifice in the distal end of the barrel adapted to receive the marking element, and a side knob in an opening in a side of the barrel that is part of a retraction system that moves the marking element through the orifice in the distal end of the barrel.

3. The multi-purpose combination writing instrument of claim 2, wherein each individual marking element is independently selected from a pencil lead, an ink marking element, a fluid marking element, or a stylus for a tablet computer.

4. The multi-purpose combination writing instrument of claim 3, wherein the marking element is an ink marking or fluid marking element and the barrel further contains a reservoir connected to the marking element.

5. The multi-purpose combination writing instrument of claim 2, wherein the opening in the side of the barrel includes a rail parallel to an axis of the base, wherein the side knob is adapted to slide along the rail, thereby moving the individual writing element through the orifice in the distal end of the barrel.

6. The multi-purpose combination writing instrument of claim 5, wherein a distal end of the rail terminates in a ledge, and a groove between the ledge and a distal end of the opening in the barrel accommodates a pin extending from the inner surface of the side knob, when inserted therein to reversibly lock the side knob in a forward position, where the individual writing element extends out the hole in the proximal end of the barrel.

7. The multi-purpose combination writing instrument of claim 6, wherein the retraction system further comprises a spring that is compressed when the side knob is in the forward position.

8. The multi-purpose combination writing instrument of claim 1, wherein the base further comprises an indented surface between the tape flag platform and the terminus of the second end.

9. The multi-purpose combination writing instrument of claim 1, wherein the rotatable cap is made of clear plastic.

10. The multi-purpose combination writing instrument of claim 1, wherein each tape flag platform has a pad of tape flags attached thereto.

11. The multi-purpose combination writing instrument of claim 1, further comprising a panel mounted on a side of the base over an opening in the base, the panel having an interior surface and an exterior surface and a slot extending through the panel from the interior surface to the exterior surface;

an oblong bar; and a banner comprising a retracted end under the interior surface of the panel and an extended end extending through the slot and attached to the oblong bar above the exterior surface of the panel.

12. The multi-purpose combination writing instrument of claim 11, wherein the banner winds into a scroll configuration in a relaxed state.

13. The multi-purpose combination writing instrument of claim 12, wherein the banner is comprised of heat treated polyester paper.

14. The multi-purpose combination writing instrument of claim 11, wherein the retracted end of the banner is attached to a retention cylinder and wraps around the retention cylinder.

15. The multi-purpose combination writing instrument of claim 11, wherein the oblong bar is in contact with the outer surface of the panel when the banner is fully retracted.

16. The multi-purpose combination writing instrument of claim 11, wherein the banner unwinds and extends outward through the slot when the oblong bar is pulled away from the outer surface of the panel.

17. The multi-purpose combination writing instrument of claim 11, wherein the panel is mounted over the opening in the base via clips that extend from the panel into the opening in the side of the base and engage with an interior surface of the base.

18. The multi-purpose combination writing instrument of claim 11, wherein the slot runs parallel to an axis of the base when the panel is mounted on the base.

19. The multi-purpose combination writing instrument of claim 11, wherein the outer surface of the panel forms a cavity above the slot adapted for receiving an inner surface of the oblong bar.

20. The multi-purpose combination writing instrument of claim 19, wherein the panel further includes two tabs on each side of the channel that extend over the oblong bar when the inner surface of the oblong bar is in the cavity and the banner is retracted.

21. The multi-purpose combination writing instrument of claim 11, wherein the outer surface of the base further comprises at least one integrated panel of the same dimensions and surface structure as the mounted panel with an oblong ridge having the same dimensions and surface structure as the oblong bar when the banner is retracted.

22. The multi-purpose combination writing instrument of claim 21, wherein the outer surface of the base comprises two integrated panels the same distance from the first and second end of the base and equidistant from each other and from the mounted panel.

23. The multi-purpose combination writing instrument of claim 11 wherein the base, barrel, panel, and oblong bar are made of molded plastic.

24. A multi-purpose combination writing instrument comprising:

three or four individual highlighter pens, each highlighter pen comprising a barrel having a proximal end and a distal end;

a base having opposing first and second ends, the first end of the base comprising one receiver corresponding to each individual highlighter pen, wherein each receiver is adapted to receive the proximal end of the barrel of a corresponding highlighter pen, the second end of the base comprising at least three tape flag platforms disposed therein;

a panel mounted on a side of the base over an opening in the base, the panel having an interior surface and an exterior surface and a slot extending through the panel from the interior surface to the exterior surface;

an oblong bar;

a banner comprising a retracted end under the interior surface of the panel and an extended end extending through the slot and attached to the oblong bar above the exterior surface of the panel; and a cap rotatably mounted on the second end of the base over the at least three tape flag platforms.

25. The multi-purpose combination writing instrument of claim 24, wherein the base further comprises the outer surface of the base further comprises at two or three integrated panels of the same dimensions and surface structure as the mounted panel with an oblong ridge having the same dimensions and surface structure as the oblong bar when the banner is retracted.

* * * * *